US006679530B2

(12) United States Patent
Krynski

(10) Patent No.: US 6,679,530 B2
(45) Date of Patent: Jan. 20, 2004

(54) COMPENSATING GATE LATCH ASSEMBLY

(76) Inventor: Michael Krynski, 1529 Indian Grove, Mississauga, Ontario (CA), L5H 2S5

( * ) Notice: Subject to any disclaimer, the term of this patent is extended or adjusted under 35 U.S.C. 154(b) by 0 days.

(21) Appl. No.: 10/171,240

(22) Filed: Jun. 14, 2002

(65) Prior Publication Data

US 2003/0230901 A1 Dec. 18, 2003

(51) Int. Cl.[7] ..... E05C 3/04
(52) U.S. Cl. ..... 292/210; 292/238
(58) Field of Search ..... 292/337, 136, 292/304, 57, 58, 238, 210

(56) References Cited

U.S. PATENT DOCUMENTS 43,105 A * 6/1864 Doen
696,411 A * 4/1902 Chesher
811,880 A * 2/1906 Steensland
1,326,554 A * 12/1919 Watson
1,939,954 A * 12/1933 Campbell ..... 292/162
2,074,759 A * 3/1937 Richards ..... 292/68
2,794,663 A * 6/1957 Grodt ..... 292/67
3,266,831 A * 8/1966 Banse ..... 292/133
3,680,902 A * 8/1972 Slattery ..... 292/341.14
6,095,576 A * 8/2000 Burton ..... 292/340

* cited by examiner

*Primary Examiner*—Gary Estremsky
(74) *Attorney, Agent, or Firm*—Edward H Oldham

(57) ABSTRACT

This application reveals a gate latch assembly in which a pivoting bolt permits substantial misalignment occur between the bolt and latch members and yet permit successful latching of the assembly.

6 Claims, 3 Drawing Sheets

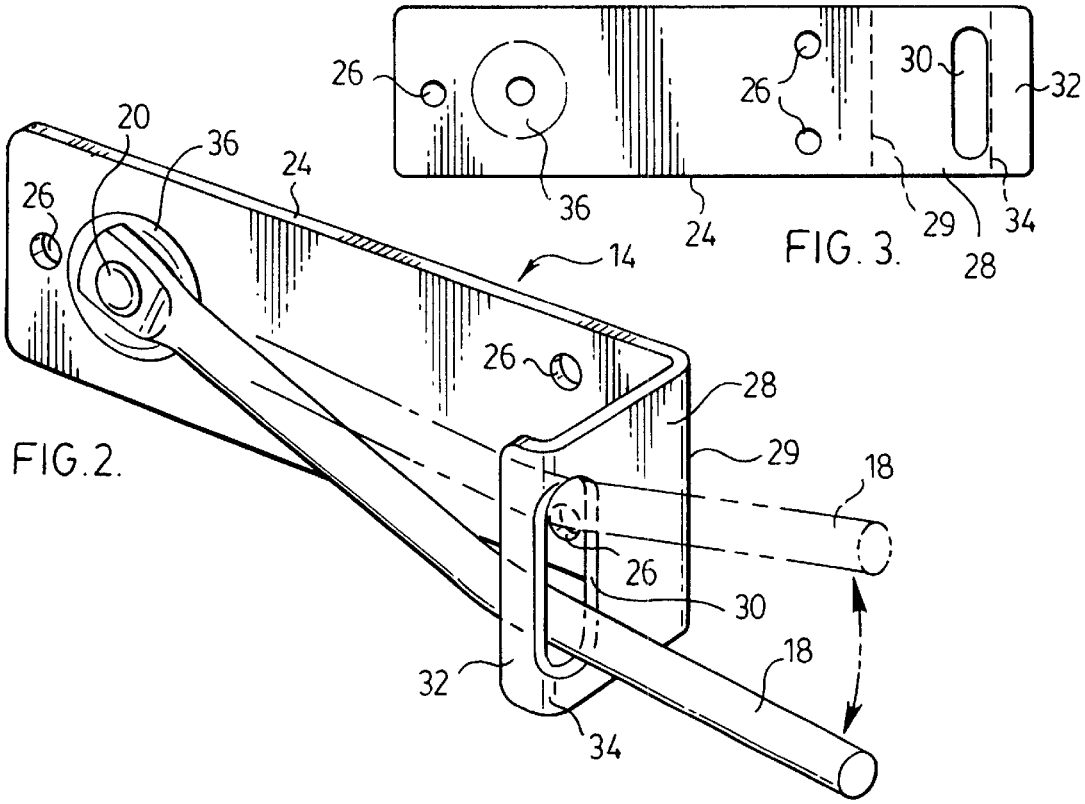
FIG. 2.
FIG. 3.
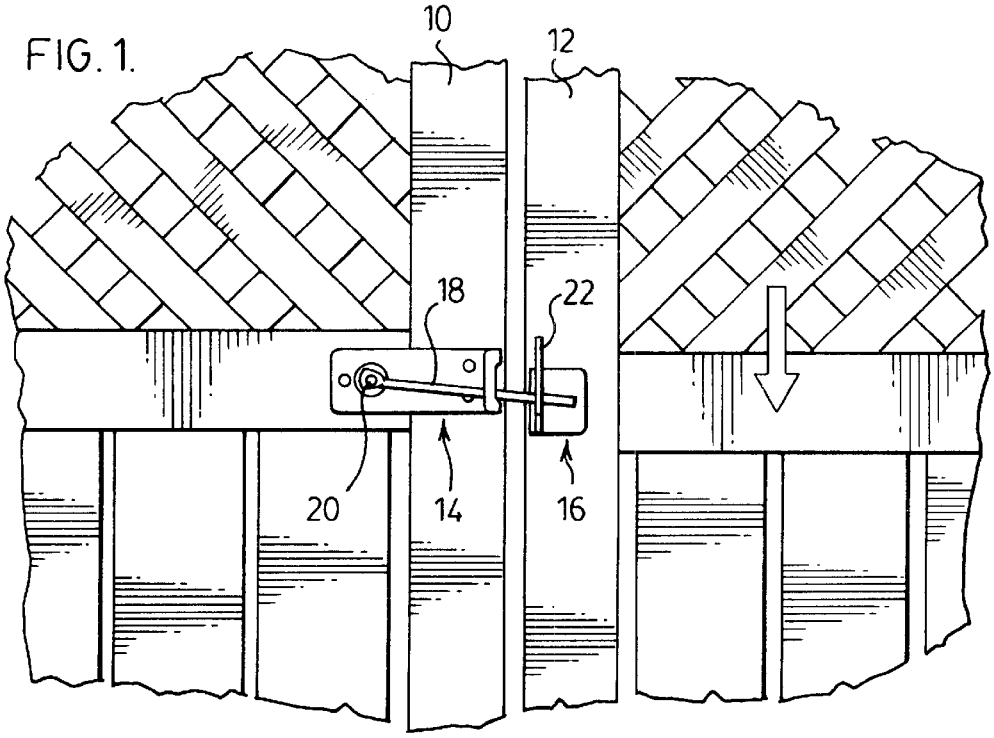
FIG. 1.

COMPENSATING GATE LATCH ASSEMBLY

BACKGROUND OF THE INVENTION

In modern contemporary fencing installations it is not unusual to include a swinging gate or door to provide access to the area being enclosed. Usually the swinging gate is provided with a "bolt" which engages and locks into a thumb latch which is mounted on the stationary adjoining wall or post. These closure installations work acceptably well until some misalignment occurs between the bolt and the latch. The misalignment can be severe in instances where the length of the gate exceeds a few feet. Misalignment frequently occurs in areas subject to frost heaving of the gate and/or the fence or post on which the thumb latch (keeper) is mounted. The frost heaving can be embarrassing because it may cause the gate to "stick" in the closed position due to the force transmitted to the latch by the misaligned bolt. The same situation occurs in hurried installations where the gate post upon which the gate is hinged settles due to improper packing of the earth about the post during construction.

Upon forcing a gate to open once misalignment has occurred, it is difficult if not impossible to close the gate and engage the bolt with the thumb latch due to the lack of registration of the bolt and latch.

It is usually necessary to remove and re-mount the latch assembly (or the bolt) to permit the gate to be closed and latched in the secure position after the misalignment of the latch and bolt has occurred. This invention will compensate for the misalignment which occurs due to faulty installation or during heaving resulting from frost penetration.

SUMMARY OF THE INVENTION

This invention allows for substantial vertical misalignment of the bolt and latch assembly of a garden gate type lock and will permit latching and unlatching of the bolt despite reasonable relative vertical misalignment of the gate and latching post.

This latch assembly comprises a standard thumb latch keeper which is permanently mounted on a stationary post or wall and wherein a latch bolt is arranged to pivot about the end of the bolt remote from the keeper so as to engage the latch keeper.

The latch assembly thus comprises a bolt which will be found to be somewhat longer than a standard latch bolt, but the end of the bolt remote from the latch is pivoted to allow the bolt to pivot in a vertical plane, and the bolt will be maintained within a guide having a slot which confines the pivoting motion of the bolt to that in a vertical plane.

The bolt will pivot in a vertical plane within the guide which will compensate for a substantial amount of misalignment between the gate and the stationary post or wall.

BRIEF DESCRIPTION OF THE DRAWINGS

FIG. 1 is a perspective view of a pivoting bolt gate latch of this invention mounted on a gate and post.

FIG. 2 is a perspective view of the latch of this invention.

FIG. 3 is a development of the base of the latch of this invention.

DESCRIPTION OF THE PREFERRED EMBODIMENT

Figure 4:
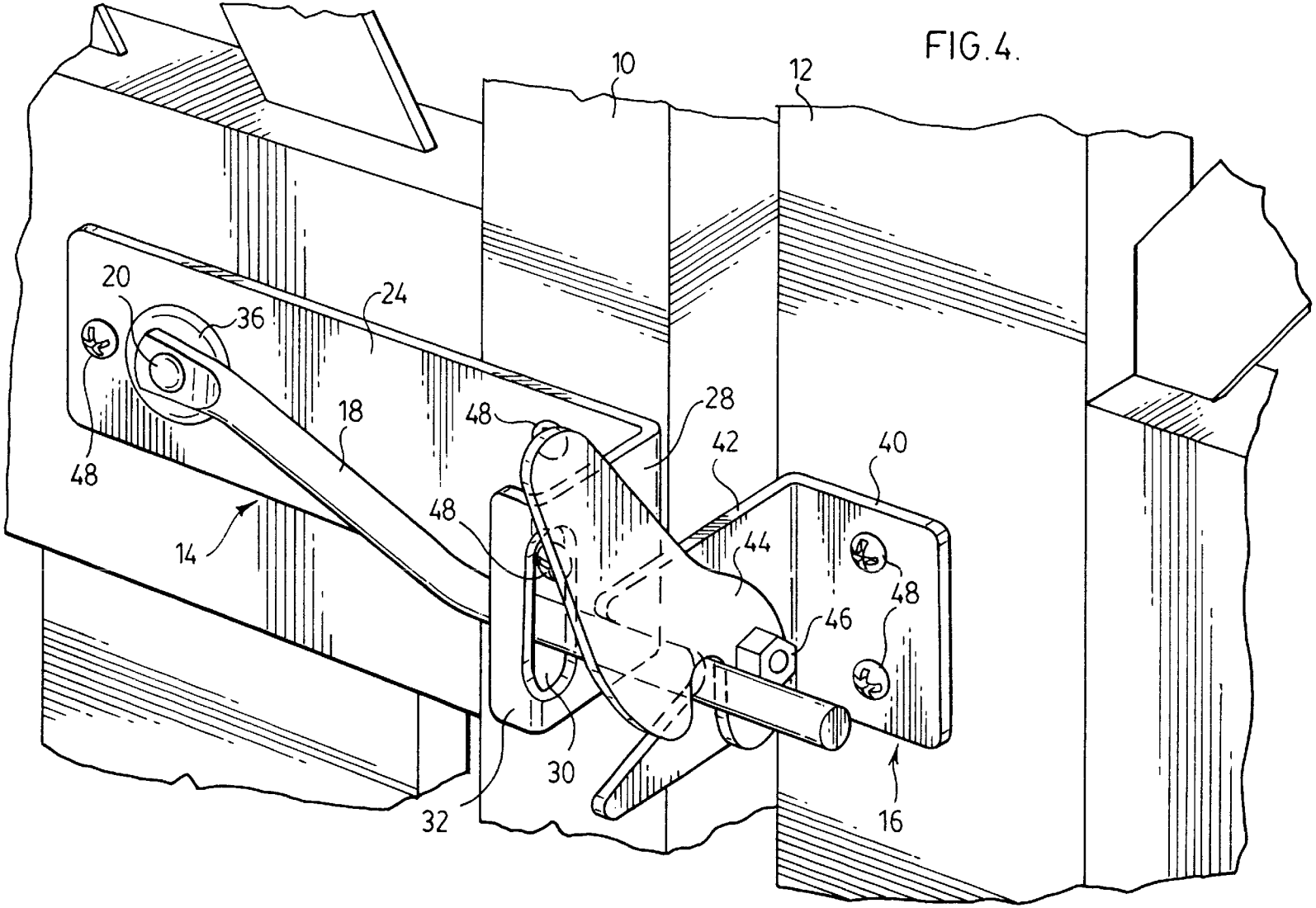
FIG. 4 is a close-up perspective view of the gate latch of this invention.

FIG. 1 shows gate 10 and a stationary post member 12 on which the latch bar assembly 14 and the keeper 16 are mounted. Latch bar assembly 14 shows a pivoting latch bar 18 mounted on pivot 20. The latch bar 18 is held in keeper 16 by a thumb release member 22. In this Figure, the post 12 is shown in a somewhat sunken position.

FIG. 2 shows the latch bar member 14 in greater detail. Member 14 comprises a one piece base 24 having mounting holes 26. Base 14 also comprises an integral upstanding guide portion 28 having a slot 30 formed therein to receive pivoting latch bar 18 therein. A base return lip 32 is formed by bending the upstanding guide portion 28 at 34 to form a large flat surface to provide an enhanced bearing surface for pivoting latch 18. The large flat exposed surface 32 is provided also for the safety of persons using the gate latch device.

Base 14 is provided with a raised dimple 36 on which pivot 20 is mounted.

FIG. 1 shows a gate installation in which for reason unknown, the post 12 has sunk somewhat. The pivoting latch 18 is able to engage keeper 16 by its ability to drop in slot 30 to accommodate the sunken position of keeper 16 on post 12. This position is represented by the position of latch bar 18 shown in solid lines in FIG. 2.

FIG. 3 shows the latch assembly having the keeper 16 engaging the pivoting latch bar 18. Keeper 16 comprises a base 40 having an upstanding flange 42 upon which thumb latch 44 is pivoted about pivot 46.

Flange 42 is provided with a "V" shaped notch to guide pivoting latch bar 18 into engagement with thumb latch 44. Screws 48 secure the latch and keeper to their respective support members 10 and 12.

FIG. 4 shows an alternative quick mounted for the latch member on a tubular gate member having a square cross section. Here gate post member 50 is engaged by a two piece base plate combination assembly 54 and 56. In this installation the base 54 is engaged by clasp 56. Base 54 is provided with slot 58 through which tongue 60 of clasp 56 is captured. Clasp 56 is shaped to surround post 50 and lip 58 is provided for attachment of bolts 60 of base 54 through clasp 56 to secure the member 52 to post 50. This method of attachment is quick, easy and robust.

Pivoting latch bar 18 is guided by slot 30 of base 54. Return lip 62 provides additional bearing surface for latch bolt 18 and a safety reinforcement as well. The presence of the lip 62 presents a flat surface parallel to the base 54 which avoids the narrow projecting lip present in most prior art devices. Besides strengthening the base of the latch assembly, this lip is designed to eliminate injuries to persons using the latch of this invention.

Figure 5:
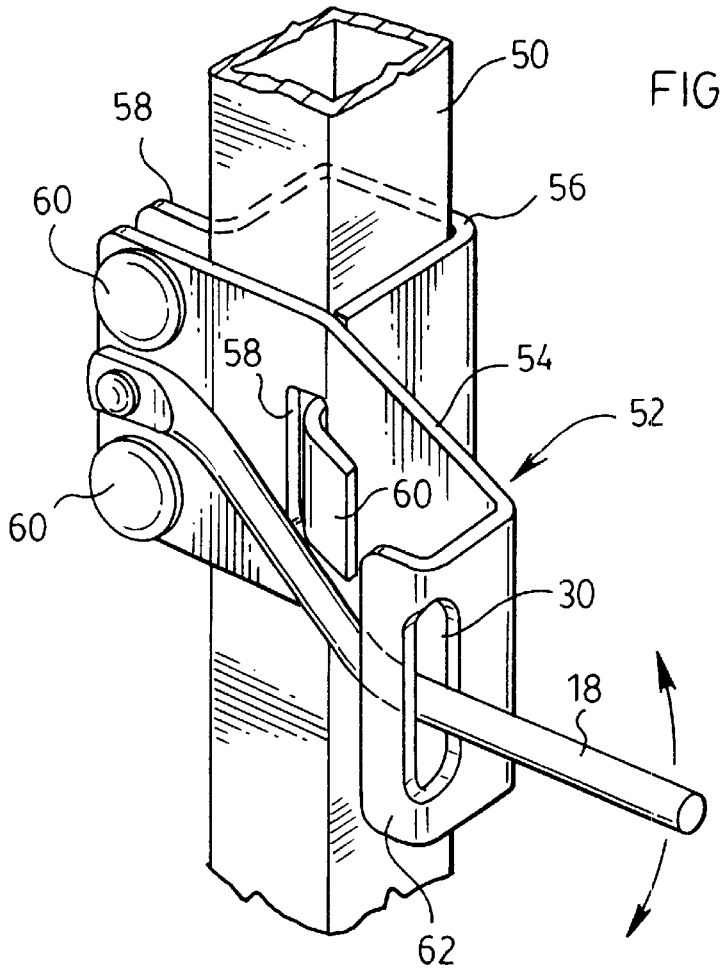
FIG. 5 shows a perspective view of an alternative embodiment of this invention.
Figure 6:
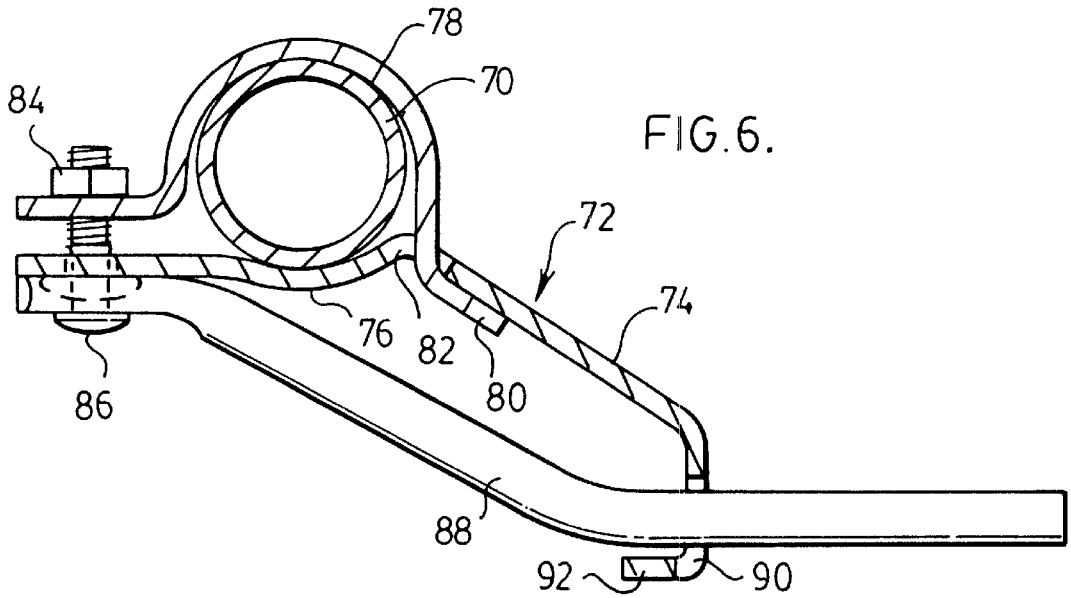
FIG. 6 shows yet another embodiment of this invention.

FIG. 5 shows a modification of the gate latch 72 of this invention to accommodate mounting on a round post 70. Base 74 of latch 72 is shaped in a similar manner of the latch 52 of FIG. 4. Base 74 is provided with a slight concavity at 76 to give more surface contact with gate post 70. Clasp 78 is made to have tongue 80 pass through slot 82 of base 74 of latch 72. Bolts 84 serve to close clasp 78 on post 70 to complete the mounting of latch 72 on post 70.

A pivot 86 provides the center of rotation for latch 88. Latch 88 is guided in slot 90 of base 74. Lip 92 functions to eliminate any sharp projections protruding from latch 72 and increase the strength of the base member 74.

In summary, the latch of this invention provides a base which is produced to have three integral cooperating flat surfaces to produce a strong base having a smoothly operating movement which is capable of compensating for settling of gate or latching posts. The latch is so produced so it can compensate for large misalignments of latch and keeper due to frost and settlement of gate and post members.

What is claimed is:

1. A latching device comprising a pivoting latch bar assembly and a latch bar keeper assembly wherein:

said pivoting latch bar assembly comprises:

an elongated base plate having first and second ends and a mounting surface located between said ends of said plate suitable for mounting said latch bar assembly on a gate post;

a latch bar pivotably attached to a flat surface of said base plate at said first end of said base plate, said base plate being bent at a first fold line at the second end of said base plate to provide a flat guide member extending orthogonally to said base plate, said guide member having an elongated slot formed therein through which, said pivoting latch bar protrudes, said slot defining the extent of the pivoting motion provided to said latching bar by said guide member, said flat guide member also being bent orthogonally at a second fold line coinciding with and extending along said slot in said guide to produce a third flat surface which folds back over said base plate and forms a bearing surface for said pivoting latch bar which presses said pivoting latch bar toward said base plate.

2. A gate latching device as claimed in claim 1 wherein said base is provided with a slot therein for receiving a base engaging clasp member which when engaged with said base combines to secure said base to a rectangular post.

3. A gate latching device as claimed in claim 1 wherein said base is provided with a slot therein for receiving a base engaging clasp member which combines with said base to secure said base to a circular post.

4. A base plate for mounting a pivoting gate latch bar thereon comprising:

a flat elongated plate having a base portion having a raised dimple near a first end of said member, and a series of mounting holes produced in said base portion, a first fold line remote from said first end, a second fold line extending parallel to and spaced somewhat from said first fold line, to produce a second portion extending from said base portion; an elongated slot formed in said second portion and having one edge of said slot fall on said second fold line;

a third portion of said plate extending a short distance beyond said second fold line to enjoy a parallel relationship with said base portion.

5. A base plate as claimed in claim 4 wherein said plate is folded at each fold line through an angle of about 90° to produce a plate having three surfaces, wherein said third portion overlies and extends parallel to said base portion.

6. A base plate as claimed in claim 5 wherein a pivot bar is mounted on said base plate so that one end of said bar extends through said slot, and the opposite end is pivotally mounted on said raised dimple.

* * * * *